US010544527B2

(12) United States Patent
Horiuchi et al.

(10) Patent No.: US 10,544,527 B2
(45) Date of Patent: Jan. 28, 2020

(54) FABRIC AND CLOTHING HAVING FLAME RETARDANCY AND HIGH VISIBILITY

(71) Applicant: Toray Industries, Inc., Tokyo (JP)

(72) Inventors: Atsushi Horiuchi, Tokyo (JP); Junji Hamada, Otsu (JP); Teiichi Katsube, Tokyo (JP)

(73) Assignee: Toray Industries, Inc., Tokyo (JP)

( * ) Notice: Subject to any disclaimer, the term of this patent is extended or adjusted under 35 U.S.C. 154(b) by 0 days.

(21) Appl. No.: 15/560,740

(22) PCT Filed: Mar. 18, 2016

(86) PCT No.: PCT/JP2016/058856
§ 371 (c)(1),
(2) Date: Sep. 22, 2017

(87) PCT Pub. No.: WO2016/152814
PCT Pub. Date: Sep. 29, 2016

(65) Prior Publication Data

US 2018/0080152 A1 Mar. 22, 2018

(30) Foreign Application Priority Data

Mar. 24, 2015 (JP) ..... 2015-061138

(51) Int. Cl.

| | |
|---|---|
| ***D03D 15/12*** | (2006.01) |
| ***D03D 1/00*** | (2006.01) |
| ***D03D 15/00*** | (2006.01) |
| ***A41D 27/08*** | (2006.01) |

(52) U.S. Cl.
CPC ..... *D03D 15/12* (2013.01); *A41D 27/085* (2013.01); *D03D 1/00* (2013.01); *D03D 15/00* (2013.01); *D10B 2401/14* (2013.01); *D10B 2501/04* (2013.01)

(58) Field of Classification Search
CPC .. A41D 27/085; A41D 31/0022; D03D 15/00; D03D 5/12; D03D 1/00; D10B 2401/14; D10B 2501/04
See application file for complete search history.

(56) References Cited

U.S. PATENT DOCUMENTS

2004/0035489 A1* 2/2004 Thiriot ..... A41D 31/00 139/420 R
2006/0030228 A1 2/2006 Truesdale, III
(Continued)

FOREIGN PATENT DOCUMENTS

AU 2012 208 990 B2 12/2014
EP 2 692 918 A2 2/2014
(Continued)

OTHER PUBLICATIONS

Extended European Search Report dated Oct. 29, 2018, of counterpart European Application No. 16768717.7.

*Primary Examiner* — Arti Singh-Pandey
(74) *Attorney, Agent, or Firm* — DLA Piper LLP (US)

(57) ABSTRACT

A fabric includes an A side mainly configured by yarns made of fibers capable of being dyed within color coordinates and in a luminance factor defined in ISO 20471; and a B side mainly configured by blended spinning yarns made of flame-retardant fibers having a self-extinguishing property and non-melting fibers.

6 Claims, 1 Drawing Sheet

A

B

(56) References Cited

U.S. PATENT DOCUMENTS

| | | | | |
|---|---|---|---|---|
| 2009/0137176 | A1* | 5/2009 | Okuya | D03D 11/00 442/189 |
| 2013/0008554 | A1 | 1/2013 | Fisher et al. | |
| 2016/0242475 | A1* | 8/2016 | Uozumi | D06P 1/0012 |
| 2016/0349416 | A1* | 12/2016 | McCoy | G02B 5/128 |
| 2017/0089008 | A1* | 3/2017 | Sanz Casado | C09K 11/7792 |
| 2017/0192142 | A1* | 7/2017 | Niwas | G02B 5/128 |
| 2017/0293056 | A1* | 10/2017 | Chen-Ho | G02B 5/128 |
| 2018/0038020 | A1* | 2/2018 | Patel | A47C 31/001 |
| 2019/0062571 | A1* | 2/2019 | Lottenbach | C09D 5/185 |

FOREIGN PATENT DOCUMENTS

| | | | |
|---|---|---|---|
| JP | 52-53065 | A | 4/1977 |
| JP | 59-199753 | A | 11/1984 |
| JP | 3994054 | B2 | 10/2007 |
| JP | 2008-509297 | A | 3/2008 |
| JP | 2013-522494 | A | 6/2013 |

* cited by examiner

A
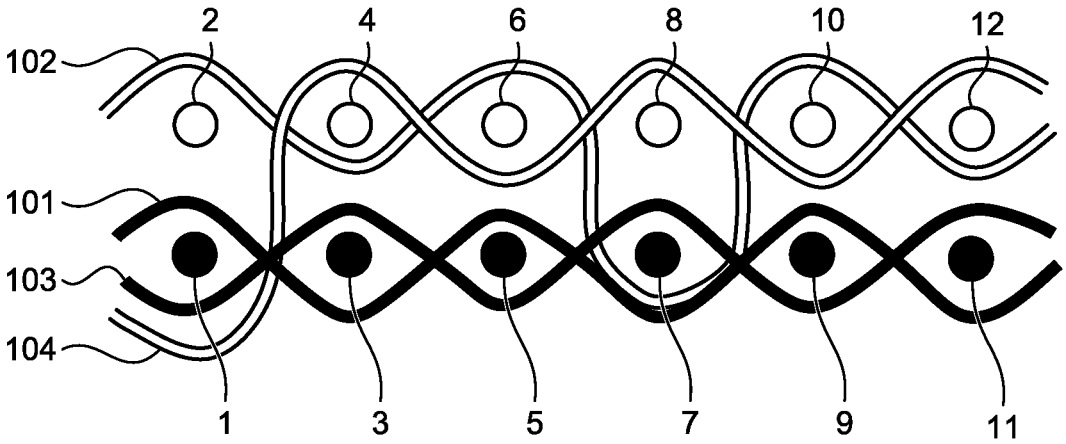
B

FABRIC AND CLOTHING HAVING FLAME RETARDANCY AND HIGH VISIBILITY

TECHNICAL FIELD

This disclosure relates to a fabric and clothing having flame retardancy and high visibility.

BACKGROUND

There are work fields exposed to contact accident risks with work vehicles and passenger vehicles on streets and outdoor work. To prevent these contact accidents, work clothes with high visibility that allows drivers to notice the worker's existence are effective. For the work clothes in such fields, clothing in which fabrics themselves are usually dyed in fluorescent yellow or fluorescent orange and a part of which incorporates retroreflective material is used. For example, high visibility clothing is defined in ISO 20471 standard.

Among the work fields requiring the high visibility clothing, there are work fields further requiring flame retardancy. Examples of the work fields include work fields for fire department workers, a part of construction sites and railway maintenance using fire such as welding, is carried out, and a part of gas/petrol stations and painting work that handle flammable substances. The clothing in these work fields is required to have flame retardancy in addition to high visibility.

In general, however, fibers having flame retardancy have poor dyeability or poor color fastness even when the fibers can be dyed and thus a problem arises of difficulty in maintaining sufficient high visibility of the fibers.

As one solution to the problem, a double sided woven fabric has been developed formed by arranging filaments previously spun-dyed in high visibility on the front side and arranging a combination of thermally stable fibers such as aramid fibers and self-extinguishing fibers such as modacrylic fibers on the back side (refer to, for example, Japanese Patent No. 3994054).

As another solution, there have been proposed reversible fabrics using dyeable flame-retardant fibers made of flame-retardant polyester fibers or the like that can be dyed in high visibility, and non-melting fibers such as aramid-based fibers (refer to, for example, Japanese Translation of PCT Application No. 2013-522494).

The color of the spun-dyed fibers used for the front side of the double sided woven fabric in Japanese Patent No. 3994054, however, is determined in advance and thus dyeing cannot be carried out to meet orders. Consequently, a problem arises of expensive storage costs when the spun-dyed fibers are stocked to some extent. In addition, in both of the proposals in Japanese Patent No. 3994054 and Japanese Translation of PCT Application No. 2013-522494, the aramid-based fibers are used and thus problems arise of a rough and rigid texture of the obtained fabric and high material costs.

Therefore, it could be helpful to provide fabric and clothing that can retain flame retardancy and have excellent economic efficiency, light resistance, and good texture by adding high visibility on one side by arranging fibers capable of high visibility dyeing and by using self-extinguishable fibers and general-purpose non-melting fibers together on the other side.

SUMMARY

We thus provide:

A fabric including: one side (an A side) mainly configured by yarns made of fibers capable of being dyed within color coordinates and in a luminance factor defined in ISO 20471; and another side (a B side) mainly configured by blended spinning yarns made of flame-retardant fibers having a self-extinguishing property and non-melting fibers.

Preferably, the fabric is a double sided woven fabric in which the two sides are connected with a part of warps or wefts as knot points.

In a preferred fabric, the fibers capable of being dyed within the color coordinates and in the luminance factor defined by the ISO 20471 configuring the one side (the A side) are made of any one of polyester fibers, nylon fibers, acrylic fibers, or a combination of these fibers.

Preferably, the non-melting fibers configuring the other side (the B side) are cellulose-based fibers.

Preferably, a blend ratio of the flame-retardant fibers having the self-extinguishing property and the non-melting fibers configuring the other side (the B side) is 60:40 to 95:5 in a mass ratio.

Preferably, the flame-retardant fibers having the self-extinguishing property configuring the other side (the B side) are modacrylic fibers.

Preferably, a LOI value (a limiting oxygen index) measured by the method of JIS L 1091E is 26 or more.

Preferably, the clothing is formed by configuring any one of the above fabric so that the one side (the A side) is a front side and the other side (the B side) is a back side.

A fabric and clothing can be obtained having flame retardancy and high visibility and excellent economic efficiency and light resistance as well as good texture, without using expensive aramid fibers. In addition, the fabric and the clothing use flame-retardant fibers having self-extinguishing property and non-melting fibers having lower Young's moduli than that of the aramid fibers on the other side (side B) and thus a fabric having softness and good wearing comfort can be obtained.

BRIEF DESCRIPTION OF THE DRAWING

FIG. 1 is a schematic cross-sectional view exemplifying and illustrating the double sided woven fabric structure of a fabric.

REFERENCE SIGNS LIST

1, 3, 5, 7, 9, 11: Wefts (blended spinning yarns made of flame-retardant fibers having self-extinguishing property and non-melting fibers)

2, 4, 6, 8, 10, 12: Wefts (yarns made of fibers that are dyeable with high visibility dye)

101, 103: Warps (blended spinning yarns made of flame-retardant fibers having self-extinguishing property and non-melting fibers)

102, 104: Warps (yarns made of fibers that are dyeable with high visibility dye)

A: A side

B: B side

DETAILED DESCRIPTION

The fabric includes a fabric including: one side (an A side) mainly configured by yarns made of fibers capable of being dyed within color coordinates and in a luminance factor (hereinafter referred to as "dyeable with the high visibility dye") defined in ISO 20471; and the other side (a B side)

mainly configured by blended-spinning yarns made of flame-retardant fibers having a self-extinguishing property and non-melting fibers.

"Excellent flame-retardant fabric" refers to a fabric satisfying ISO 14116, the standard of flame-retardant protective clothes, and having no hole generation and an afterflame time of 2 seconds or less in the flame resistance test according to the method of ISO 15025 A.

"Excellent high visibility" refers to fluorescent yellow, fluorescent orange and the like, and characteristics in which when the conditions in the color coordinates and the luminance factor defined in ISO 20471, EN 1150, that is, the test defined in ISO 20471 (2013) is carried out, the fluorescent yellow is a color having color coordinates of (x, y): (0.387, 0.610) (0.356, 0.494) (0.398, 0.452) (0.460, 0.540) and a luminance factor β of more than 0.70 and the fluorescent orange is a color having color coordinates of (x, y): (0.610, 0.390) (0.535, 0.375) (0.570, 0.340) (0.655, 0.345) and a luminance factor β of more than 0.40.

On one side (the A side) of the fabric, it is important to arrange yarns mainly made of fibers that are dyeable with the high visibility dye ("dyeable fibers"). Examples of the fibers that are dyeable with the high visibility dye include polyester-based fibers that are dyeable with a disperse dye, acrylic-based fibers that are dyeable with a cationic dye, and polyester-based fibers modified to be dyeable with a cationic dye, and dyeable nylon fibers with an acidic dye. Fibers other than the fibers dyeable with the high visibility dye may be used on one side (the A side) of the fabric. It is desirable that a ratio of dyeable fibers be preferably at least 90% or more of the surface area in the A side. Examples of fibers used on the A side and having purposes other than the high visibility include different material fibers that are dyeable in different colors, metal salt-containing fibers to add antistatic properties, carbon-containing fibers, and carbon fibers. These fibers may be arranged in a stripe shape, a grid shape or the like. The ratio of dyeable fibers on the A side may be calculated by the area ratio when the A side of the fabric is observed under a microscope. To maintain the light fastness of the A side of the fabric, it is not desired that cellulose-based fibers are not added.

The above polyester fibers are general polyester fibers for clothing and examples of the polyester fibers include the polyester fiber "TETORON" (registered trademark) manufactured by Toray Industries, Inc. The acrylic fibers are general acrylic fibers for clothing and examples of the acrylic fibers include the acrylic fiber "TORRELON" (registered trademark) manufactured by Toray Industries, Inc. The polyester fibers modified to be dyeable with a cationic dye refer to polyester fibers obtained by copolymerizing a monomer having a dye site of a cationic dye, and such polyester fibers include, for example, "LOC", "LOC II", and "POLYROFT" (registered trademark) manufactured by Toray Industries, Inc. Nylon-based fibers are general nylon fibers for clothing and such fibers include, for example, "TORAY NYLON" (registered trademark). The above dyeable fibers may be used singly or in combination of these fibers.

The dyeable fibers do not necessarily require a flame retardant treatment. The fibers in which a halogen-based or phosphorus-based flame retardant is kneaded may also be used. Such flame-retarded polyester fibers include, for example, "UNFLA" (registered trademark) manufactured by Toray Industries, Inc.

Among the above dyeable fibers, particularly, the cation dyeable polyester fibers are preferably used as the dyeable fibers from the viewpoints of texture and fastness.

As the dyeable fibers, spun yarns of No. 20 to No. 60 having a single fiber fineness of 0.5 dtex to 5.0 dtex, a fiber length of 30 mm to 80 mm, and a shape of round cross section are preferably used. As a multifilament, a multifilament having a single fiber fineness of 0.5 dtex to 5.0 dtex and a filament number of 50 to 200 is preferably used.

The high visibility dye is a dye having a coloring matter that emits fluorescence when the coloring matter is irradiated with light. A disperse dye is used for the polyester fibers, a cationic dye is used for the acrylic fibers and the cationic dyeable polyester fibers, and an acidic dye is used for the nylon fibers.

On the other side (the B side) of the fabric, it is important to use blended yarns made of the flame-retardant fibers having the self-extinguishing property and non-melting fibers. The flame-retardant fibers having the self-extinguishing property refer to fibers shielded from oxygen to prevent from fire spread by generating fire-extinguishing gas during burning. Specific examples of the fibers include modacrylic fibers made of a copolymer of acrylonitrile and a halogen-containing compound, and flame-retarded polyester fibers with which a halogen-based flame retardant or a phosphorus-based flame retardant is kneaded. As the flame-retardant fibers having the self-extinguishing property, fibers having a single fiber fineness of 0.5 dtex to 5.0 dtex and a fiber length of 30 mm to 80 mm are preferably used.

The flame-retardant fibers having the self-extinguishing property preferably have an initial tensile tension resistance (Young's modulus) of 15 (cN/dtex) to 65 (cN/dtex). By using the flame-retardant fibers having self-extinguishing property having the initial tensile strength resistance within the above range, it is possible to add softness to the texture of the fabric.

The non-melting fibers refer to fibers that are carbonized without melting by heat. Specific examples of the fibers include natural fibers such as cotton, hemp, wool, and silk and synthetic fibers such as rayon. Among those, cellulose-based fibers such as cotton and rayon are preferably used in view of versatility. As the non-melting fibers, fibers having a single fiber fineness of 0.5 dtex to 5.0 dtex and a fiber length of 30 mm to 80 mm are preferably used.

It is preferable that the blending ratio of the flame-retardant fibers having the self-extinguishing property and the non-melting fibers constituting the yarns (blended yarns) used on the B side is 60:40 to 95:5 by mass ratio, and, more preferably 70:30 to 90:10. When the blending ratio of the non-melting fibers is more than 40% by mass, it is difficult to adequately prevent the fire spread due to an increase in the amount of flammable gas generated by decomposition. When the blending ratio of the non-melting fibers is less than 5% by mass, a tendency is observed that the fire spread prevention effect caused by carbonization is weakened.

The non-melting fibers such as the cellulose-based fibers are flammable by themselves. When the blended yarns of the modacrylic fibers and the non-melting fibers have an optimum ratio, it is possible to add flame resistance to the entire fabric due to the effect of the fire-extinguishing gas generated from the modacrylic fibers and the effect of reduction of fire spread by the carbonization of the non-melting fibers themselves.

On the other side (the B side) of the fabric, fibers may be used which are other than the blended yarns of the flame-retardant fibers having the self-extinguishing property and the non-melting fibers. It is, however, preferable that the blended yarns of the flame-retardant fibers having the self-extinguishing property and the non-melting fibers are included in a ratio of 90% by mass or more in the yarns configuring the B side. The configuration ratio of the B side of the blended yarns of the flame-retardant fibers having the self-extinguishing property and the non-melting fibers may be calculated by the mass ratio of the raw material fibers.

Among the above non-melting fibers, the cellulose-based fibers are preferably used because the cellulose-based fibers can provide comfortable clothes due to soft texture and hygroscopicity.

As the fabric, a woven fabric or a knitted fabric can be configured of different materials for the A side (front side) and the B side (back side) by changing kinds of yarns on the front side and the back side in double sided weaving or double sided knitting. The fabric may be a multilayer woven fabric or multilayer knitted fabric having an intermediate layer.

More preferably, the A side and the B side of the fabric are formed of a double sided woven fabric having knot points formed by a part of warp or weft. To maintain the high visibility for a long period of time even when the A side used as the front side of the high visibility fabric is exposed to light, it is preferable that the fibers used for the B side that is inferior in light fastness cannot be seen from the side of the A side as much as possible. As a preferable aspect, the number of the knot points in the double sided woven fabric is one knot point for 2 to 8 warps or wefts. When the number of the knot points is greater than the above range (one knot point for one warp or weft), it becomes difficult to maintain the high visibility for a long period of time under the use situation where the A side is exposed to light. When the number of the knot points is less than the above range (one knot point for nine or more of the warps or wefts), a tendency of lower flame resistance may be observed.

For the same reason, preferably, a cover factor of the woven fabric, that can be calculated by the following formula, is 1500 to 25000, a weight per unit area is 100 g/m$^2$ to 350 g/m$^2$, and a woven fabric density is 70 yarns/2.54 cm to 200 yarns/2.54 cm in both warps and wefts.

$$\text{Cover factor (CF)} = x \cdot d^{1/2} + y \cdot d'^{1/2}$$

x: the number of warps per 2.54 cm in the woven fabric
y: the number of wefts per 2.54 cm in the woven fabric
d: Total fineness of spun yarns of warp (denier)
d': Total fineness of spun yarns of warp (denier)

FIG. 1 illustrates a schematic cross-sectional view for exemplifying and illustrating the double sided woven fabric structure of the fabric. In FIG. 1, wefts 2, 4, 6, 8, 10, and 12 arranged on the side of the A side denote the yarns made of the dyeable fibers. Wefts 1, 3, 5, 7, 9, and 11 arranged on the side of the B side denote the blended yarns made of the flame-retardant fibers having the self-extinguishing property and the non-melting fibers. Warps 102 and 104 denote the fibers that are dyeable with the high visibility dye. Warps 101 and 103 denote the blended yarns made of the flame-retardant fibers having the self-extinguishing property and the non-melting fibers.

The fabric is suitably used for clothing such as work clothes and uniforms for fire sites, disaster relief activities, construction sites, road construction sites, wiring construction sites, chemical plants, machine manufacturing plants, steel works, ports, aircraft guidance and maintenance, highway conservation, railway maintenance, and gas stations. In particular, the fabric is most suitable for work clothes for fire department workers, construction workers carrying out fire operations such as welding, and railway maintenance workers. When the fabric is used as the clothing, the A side is used as the front side and the B side is used as the back side.

EXAMPLES

Next, our fabrics and clothing will be described with reference to Examples. Characteristics (measurements) in Examples and Comparative Examples are in accordance with the following method.

1. Flame Retardancy:

A LOI value was measured in accordance with a method defined in JIS L 1091 (1999) E. In this method, minimum oxygen and nitrogen capacities required for burning a material in the atmosphere were measured and the limiting oxygen index is determined by calculating the ratio (%) of oxygen to oxygen and nitrogen. The sample having a LOI value of 26 or more was marked as passed.

An afterflame time was measured in accordance with a method defined in ISO 15025 (2000) A. In this method, a time when the material itself continued to burn with flame after removing the ignition source was measured. The sample having an afterflame time of 2 seconds or less was marked as passed.

2. High Visibility:

High visibility was evaluated by carrying out a test defined in ISO 20471 (2013). The sample of the fluorescent yellow having color coordinates within a range of (x, y): (0.387, 0.610) (0.356, 0.494) (0.398, 0.452) (0.460, 0.540) and a luminance factor β of more than 0.70 was marked as passed. Evaluation of the high visibility after xenon light resistance test was also carried out.

3. Light Resistance

The weather fastness was evaluated by carrying out a test with ultraviolet carbon arc lamp light defined in JIS L 0842 (2004) and the sample evaluated as the fourth class or better was marked as passed.

4. Texture

Sensory evaluation was carried out on the texture of the fabric after dyeing and the sample was evaluated in three stages of Soft (S), Medium (M), and Hard (H).

Example 1

No. 40 spun yarn single yarns made of 100% by mass of cationic dyeable polyester fibers having a single fiber fineness of 1.45 dtex and a length of 51 mm were used on the A side. In addition, No. 40 spun yarn single yarns (blended yarns) having a blending ratio of 80% by mass of modacrylic fibers having a single fiber fineness of 2.2 dtex and a length of 51 mm and a 20% by mass of rayon fibers having a single fiber fineness of 2.2 dtex and a length of 51 mm were used on the B side. A double sided woven fabric having the framework structure illustrated in FIG. 1 and having knot points in a frequency of one knot point for 6 warps and a woven fabric density of warps of 184 yarns/2.54 cm (92 yarns/2.54 cm in both of the A side and the B side) and a fabric density of wefts of 160 yarns/2.54 cm (80 yarns/2.54 cm in both of the A side and the B side) was prepared. Next, the obtained double sided woven fabric was dyed in fluorescent yellow defined in ISO 20471 by piece dyeing using a cationic dye and a reactive dye. For the dyed fabric, the measurement results of characteristics for flame retardancy, high visibility, light resistance, and texture are listed in Table 1.

Example 2

No. 40 spun yarn single yarns made of 100% by mass of cationic dyeable polyester fibers having a single fiber fineness of 1.45 dtex and a length of 51 mm were used on the A side. In addition, No. 40 spun yarn single yarns (blended yarns) having a blending ratio of 90% by mass of modacrylic fibers having a single fiber fineness of 2.2 dtex and a length of 51 mm and a 10% by mass of rayon fibers having a single fiber fineness of 2.2 dtex and a length of 51 mm were used on the B side. A fabric (double sided woven fabric) was prepared in a manner similar to Example 1 and dyed in a similar color. For the dyed fabric, the measurement results of characteristics for flame retardancy, high visibility, light resistance, and texture are listed in Table 1.

Example 3

No. 40 spun yarn single yarns made of 100% by mass of cationic dyeable polyester fibers having a single fiber fineness of 1.45 dtex and a length of 51 mm were used on the A side. In addition, No. 40 spun yarn single yarns (blended yarns) having a blending ratio of 95% by mass of modacrylic fibers having a single fiber fineness of 2.2 dtex and a length of 51 mm and a 5% by mass of rayon fibers having a single fiber fineness of 2.2 dtex and a length of 51 mm was used on the B side. A fabric (double sided woven fabric) was prepared in a manner similar to Example 1 and dyed in a similar color. For the dyed fabric, the measurement results of characteristics for flame retardancy, high visibility, light resistance, and texture are listed in Table 1.

Example 4

No. 40 spun yarn single yarns made of 100% by mass of polyester fibers having a single fiber fineness of 1.45 dtex and a length of 51 mm were used on the A side. In addition, No. 40 spun yarn single yarns (blended yarns) having a blending ratio of 95% by mass of modacrylic fibers having a single fiber fineness of 2.2 dtex and a length of 51 mm and a 5% by mass of rayon fibers having a single fiber fineness of 2.2 dtex and a length of 51 mm were used on the B side. A fabric (double sided woven fabric) was prepared in a manner similar to Example 1 and dyed in a similar color. For the dyed fabric, the measurement results of characteristics for flame retardancy, high visibility, light resistance, and texture are listed in Table 1.

Example 5

No. 40 spun yarn single yarns made of 100% by mass of nylon fibers having a single fiber fineness of 1.45 dtex and a length of 51 mm were used on the A side. In addition, No. 40 spun yarn single yarns (blended yarns) having a blending ratio of 95% by mass of modacrylic fibers having a single fiber fineness of 2.2 dtex and a length of 51 mm and a 5% by mass of rayon fibers having a single fiber fineness of 2.2 dtex and a length of 51 mm were used on the B side. A fabric (double sided woven fabric) was prepared in a manner similar to Example 1 and dyed in a similar color. For the dyed fabric, the measurement results of characteristics for flame retardancy, high visibility, light resistance, and texture are listed in Table 1.

Comparative Example 1

No. 40 spun yarn single yarns made of 80% by mass of cationic dyeable polyester fibers having a single fiber fineness of 1.45 dtex and a length of 51 mm and 20% by mass of modacrylic fibers having a single fiber fineness of 2.2 dtex and a length of 51 mm were used on the A side. In addition, No. 40 spun yarn single yarns (blended yarns) having a blending ratio of 80% by mass of modacrylic fibers having a single fiber fineness of 2.2 dtex and a length of 51 mm and a 20% by mass of cationic dyeable polyester fibers having a single fiber fineness of 1.45 dtex and a length of 51 mm were used on the B side. A fabric (double sided woven fabric) was prepared in a manner similar to Example 1 and dyed in a similar color. For the dyed fabric, the measurement results of characteristics for flame retardancy, high visibility, light resistance, and texture are listed in Table 1.

Comparative Example 2

No. 40 spun yarn single yarns made of 100% by mass of cationic dyeable polyester fibers having a single fiber fineness of 1.45 dtex and a length of 51 mm were used on the A side. In addition, No. 40 spun yarn single yarns (blended yarns) having a blending ratio of 80% by mass of modacrylic fibers having a single fiber fineness of 2.2 dtex and a length of 51 mm and a 20% by mass of cationic dyeable polyester fibers having a single fiber fineness of 1.45 dtex and a length of 51 mm were used on the B side. A fabric (double sided woven fabric) was prepared in a manner similar to Example 1 and dyed in a similar color. For the dyed fabric, the measurement results of characteristics for flame retardancy, high visibility, light resistance, and texture are listed in Table 1.

Comparative Example 3

No. 40 spun yarn single yarns made of 100% by mass of cationic dyeable polyester fibers having a single fiber fineness of 1.45 dtex and a length of 51 mm were used on the A side. In addition, No. 40 spun yarn single yarns (blended yarns) having a blending ratio of 95% by mass of meta-aramid fibers having a single fiber fineness of 2.5 dtex and a length of 51 mm and a 5% by mass of rayon fibers having a single fiber fineness of 2.2 dtex and a length of 51 mm were used on the B side. A fabric (double sided woven fabric) was prepared in a manner similar to Example 1 and dyed in a similar color. For the dyed fabric, the measurement results of characteristics for flame retardancy, high visibility, light resistance, and texture are listed in Table 1.

TABLE 1

| Items | | Example 1 | Example 2 | Example 3 | Example 4 | Example 5 | Comparative Example 1 | Comparative Example 2 | Comparative Example 3 |
|---|---|---|---|---|---|---|---|---|---|
| Blending ratio of No. 40 spun yarn used in A side | Cationic dyeable polyester (1.45 dtex × 51 mm) | 100% | 100% | 100% | — | — | 80% | 100% | 100% |
| | Modacrylic (2.2 dtex × 51 mm) | — | — | — | — | — | 20% | — | — |

TABLE 1-continued

| Items | | Example 1 | Example 2 | Example 3 | Example 4 | Example 5 | Comparative Example 1 | Comparative Example 2 | Comparative Example 3 |
|---|---|---|---|---|---|---|---|---|---|
| Blending ratio of No. 40 spun yarn used in B side | Polyester (1.45 dtex × 51 mm) | — | — | — | 100% | — | — | — | — |
| | Nylon (1.45 dtex × 51 mm) | — | — | — | — | 100% | — | — | — |
| | Modacrylic (2.2 dtex × 51 mm) | 80% | 90% | 95% | 95% | 95% | 80% | 80% | — |
| | Rayon (2.2 dtex × 51 mm) | 20% | 10% | 5% | 5% | 5% | — | — | 5% |
| | Cationic dyeable polyester (1.45 dtex × 51 mm) | — | — | — | — | — | 20% | 20% | — |
| | Meta-aramid (2.5 dtex × 51 mm) | — | — | — | — | — | — | — | 95% |
| Woven fabric density (A side) | Yarns/2.54 cm | 92 × 80 | 92 × 80 | 92 × 80 | 92 × 80 | 92 × 80 | 92 × 80 | 92 × 80 | 92 × 80 |
| Woven fabric density (B side) | Yarns/2.54 cm | 92 × 80 | 92 × 80 | 92 × 80 | 92 × 80 | 92 × 80 | 92 × 80 | 92 × 80 | 92 × 80 |
| Cover factor (A side) | — | 1983 | 1983 | 1983 | 1983 | 1983 | 1983 | 1983 | 1983 |
| Cover factor (B side) | — | 1983 | 1983 | 1983 | 1983 | 1983 | 1983 | 1983 | 1983 |
| Flame retardancy | LOI value (JIS L 1091 E method) | 29 | 29 | 30 | 30 | 30 | 30 | 28 | 28 |
| | Afterflame time (ISO 15025 A method) | 2 sec or less | 2 sec or less | 2 sec or less | 2 sec or less | 2 sec or less | 2 sec or less | 4 sec (not passed) | 2 sec or less |
| High visibility | Fluorescent yellow color coordinates (ISO 20471) | Pass | Pass | Pass | Pass | Pass | Pass | Pass | Pass |
| | After xenon irradiation | Pass | Pass | Pass | Pass | Pass | Not pass | Pass | Pass |
| Light resistance | Light fastness (JIS L 0842) | Class 4-5 | Class 4-5 | Class 4-5 | Class 4 | Class 4 | Class 2-3 (not pass) | Class 4 | Class 3-4 (not pass) |
| Texture | S: Soft, M: Moderate, H Hard (sensory evaluation) | S | S | M | M | S | S | M | H |

The fabrics obtained in Examples 1 to 5 described above have LOI values (limiting oxygen indices) measured by the JIS L 1091 E method, of 26 or more, which is generally referred to as flame-retardant fibers. In addition, it was demonstrated that the afterflame time measured by the ISO 15025 A method defined by ISO 14116, which is the international flame resistant standard, was less than 2 seconds and the flame did not reach the upper edge and both side edges of the test specimen.

The fabrics obtained in Examples 1 to 5 were dyeable to fluorescent yellow having a luminance factor β of 0.70 or more within the color coordinates defined in the ISO 20471 standard and maintained the color within the above color coordinates after the xenon light resistance test according to ISO 105-B02. Therefore, it was demonstrated that these fabrics satisfied the requirements of the ISO 20471 standard.

Moreover, the fabrics of Example 1 to 5 satisfied the fourth grade in the light fastness test using carbon are defined in JIS L 0842 and the texture was also Moderate or better. From the viewpoint of the light fastness and the texture, it was demonstrated that use of the aramid (Comparative Example 3) that is inferior in light fastness and texture was not adequate even on the B side of the fabric.

The invention claimed is:

1. A two-layered woven fabric comprising double sided wovens including an upper layer that is an A side and a lower layer that is a B side, wherein:

the A side is mainly configured by yarns made of fibers adapted to being dyed within color coordinates and in a luminance factor defined in ISO 20471, the A side is made of at least one selected from the group consisting of polyester fibers, nylon fibers and acrylic fibers, the yarns made of fibers adapted to being dyed do not have a flame retardant treatment, the B side is mainly configured by blended spinning yarns made of flame-retardant fibers having a self-extinguishing property and non-melting fibers, and the A side and the B side of the double sided woven are connected with a part of warps or wefts as knot points.

2. The fabric according to claim 1, wherein the non-melting fibers configuring the B side are cellulose-based fibers.

3. The fabric according to claim 1, wherein a blend ratio of the flame-retardant fibers having the self-extinguishing property and the non-melting fibers configuring the B side is 60:40 to 95:5 in a mass ratio.

4. The fabric according to claim 1, wherein the flame-retardant fibers having the self-extinguishing property configuring the B side are modacrylic fibers.

5. The fabric according to claim 1, wherein a LOI value, which corresponds to a limiting oxygen index, measured by JIS L 1091 E is 26 or more.

6. Clothing formed by configuring the fabric according to claim 1 so that the A side is a front side and the B side is a back side.

* * * * *